US006286154B1

(12) United States Patent
Pitts et al.

(10) Patent No.: US 6,286,154 B1
(45) Date of Patent: Sep. 11, 2001

(54) PORTABLE BEDSIDE TOILET COMMODE

(76) Inventors: Constance Linda Pitts, 5748 Clark Rd., West Manchester, OH (US) 45382-9608; Stanley Bruce Pitts, 5748 Clark Rd., W. Manchester, OH (US) 45382

( * ) Notice: Subject to any disclaimer, the term of this patent is extended or adjusted under 35 U.S.C. 154(b) by 0 days.

(21) Appl. No.: 09/492,681

(22) Filed: Jan. 27, 2000

Related U.S. Application Data

(60) Provisional application No. 60/143,623, filed on Jul. 12, 1999.

(51) Int. Cl.[7] ..... A47K 11/06
(52) U.S. Cl. ..... 4/480; 4/254
(58) Field of Search ..... 4/479, 480, 483, 4/484, 578.1, 579, 254

(56) References Cited

U.S. PATENT DOCUMENTS 3,047,884 * 8/1962 Grondona ..... 4/254
4,334,330 * 6/1982 Marshall ..... 4/480
5,023,962 * 6/1991 Steljes ..... 4/480

* cited by examiner

*Primary Examiner*—Charles E. Phillips

(57) ABSTRACT

This invention entitled "Portable Bedside Toilet Commode" is a health care article of manufacture with a uniquely designed form. This unique invention affords greater convenience, comfort, ease-of-use for persons with limited mobility (whether temporary or permanent; and whether due to injury, disease, birth defect, or aging) and greater ease for their health care providers.

4 Claims, 4 Drawing Sheets

PORTABLE BEDSIDE TOILET COMMODE

CROSS-REFERENCE TO RELATED APPLICATIONS

Figure 1:
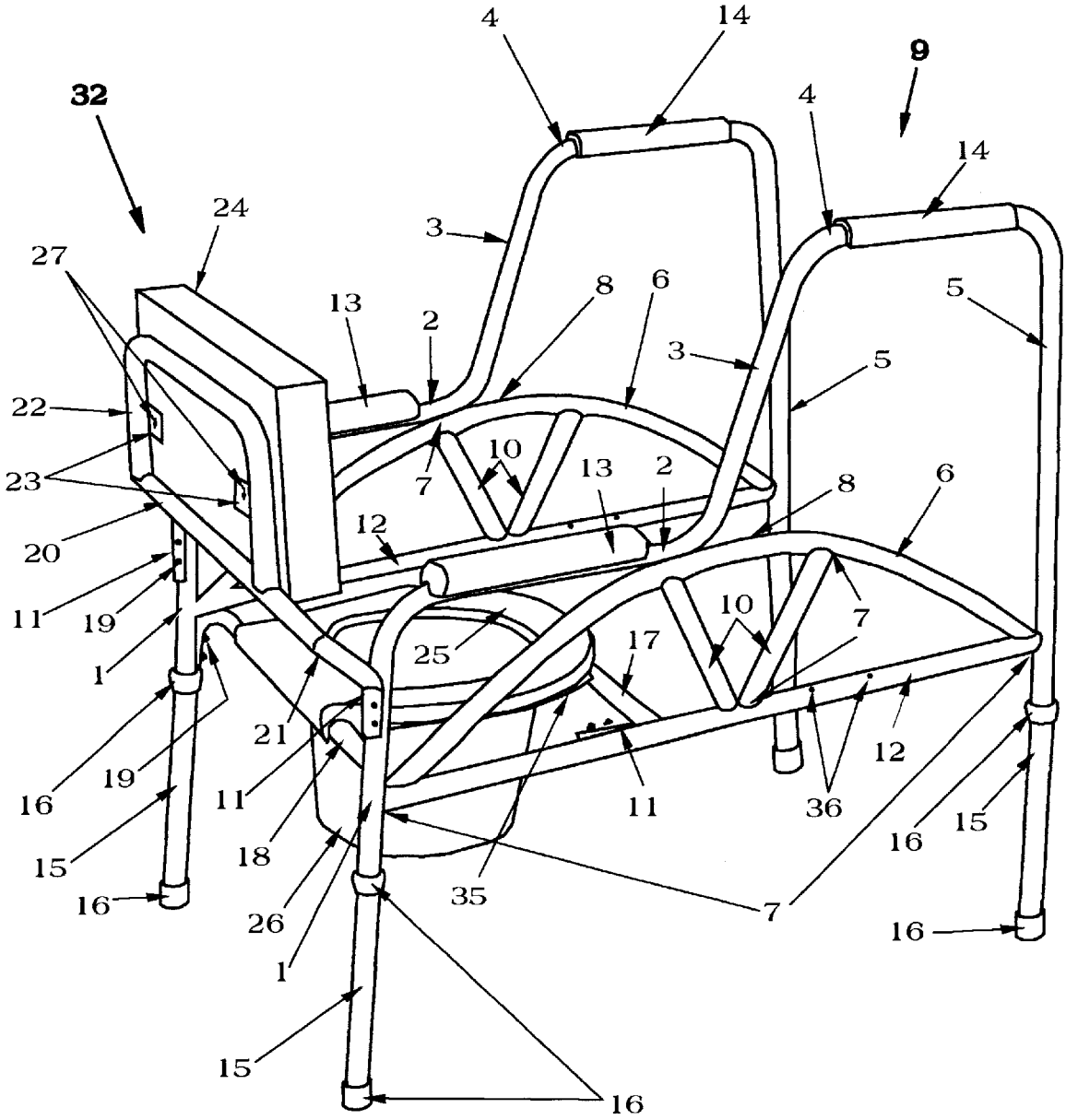

Provisional Application No. 60/143,623 filing date: Jul. 12, 1999.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention is in the field of health care devices and is designed to improve the quality of life for mobility impaired persons and their health care providers. This new and unique utility invention for an article of manufacture is a tremendous improvement over prior art.

This invention is uniquely different from prior art.

For example U.S. Pat. No. 5,023,962 to Steljes (1991) reveals an invalid aid with commode station for use of invalid patients who cannot use a walking device and who need to access the device from the bed. However, it provides no aid to an invalid patient who is able to use a wheelchair or a walker. Therefore it has limited use.

Another U.S. Pat. No. 4,334,330 to Marshall (1982) describes a device for use when a patient is partially immobilized and bedridden. The invalid patient with casts on arms and/or legs who cannot stand, even with assistance. However, it provides limited aid to an invalid patient who is able to use a wheelchair or a walker. Further, its limited use design, while helpful to a patient in leg casts, is awkward for a partially mobile patient.

Further U.S. Pat. No. 3,047,884 to Grondona (1962) discloses a body assist for use with a plumbed toilet. The sides of this device, if extended to double their length, would lack structural integrity and would probably buckle under the normal downward pressure while using it for support while maneuvering. As designed, this device is an aid to a patient having difficulty rising and sitting on a plumbed toilet. It is not portable and is not a complete commode design. It would not be of much use to a patient who uses a wheelchair and/or walker nor can it be used from a bed.

BRIEF SUMMARY OF THE INVENTION

This invention was developed to answer an urgent need by persons of a reduced mobility condition to use a portable bedside toilet commode with greater ease and independence than provided by other available inventions. This unique invention allows a person with reduced mobility to transition from a wheelchair, bed, or walker and enter the initial standing area of this portable bedside toilet commode. Grasping the hand rails, the person can maneuver himself/herself around comfortably. When he/she has turned 180 degrees around, the person can back up slightly and lower himself/herself to the toilet seat (facilitated by the continuous and slanted rails that connect the upper (standing position) hand rails to the lower (sitting position) chair arms. Because of the slant rails rising above the chair arms, the limited mobility person is more able to support himself/herself during personal hygiene. A person with limited mobility is again helped by this unique invention in rising and standing from a sitting position by use of the slant rails and hand rails. He/she is able to use this unique structure to assist in rising from a sitting position and balancing himself/herself while adjusting clothing. Depending on the degree of limited mobility, the person of reduced or limited mobility may need some assistance. In that case, the assistant will find this unique invention aids in the ease and comfort afforded both the limited mobility person and the assistant.

The portable bedside toilet commode invention described herein is a unique and needed solution necessary to ease the life of many persons of limited mobility. It would be of special interest to hospitals, patient recovery and rehabilitation centers, nursing homes, home health care, etc. This invention can be scaled down or up to accommodate children or larger adults.

Use of heavier structural members (especially for large or heavy weight persons) may be necessary, but does not alter the basic concept and unique provisions of this invention. Alterations in design of arm rests, hand grips, toilet seat, waste recovery bucket, back-rest cushion, and/or adjustable legs does not alter the basic concept and unique provisions of this invention. The use of round tubular steel was used for this invention, but the use of square tubing of steel, aluminum, or other materials does not alter the basic concept and unique provisions of this portable bedside toilet commode invention.

BRIEF DESCRIPTION OF SEVERAL VIEW OF THE DRAWING

FIG. 1:

Portable Bedside Toilet Commode (without optional attachments). Shown in isometric view.

FIG. 2:

Arched Support Assembly, the major part of the Portable Bedside Toilet Commode. Shown in elevation view. Only one side is shown.

FIG. 3:

Back Support for the Portable Bedside Toilet Commode. Detail shown in isometric view.

FIG. 4:

Tip-inhibiting Leg attachment and Anti-tip Strap attachment for the Portable Bedside Toilet Commode. Shown in isometric view. Only one of each is shown.

DETAILED DESCRIPTION OF THE INVENTION

Figure 2:
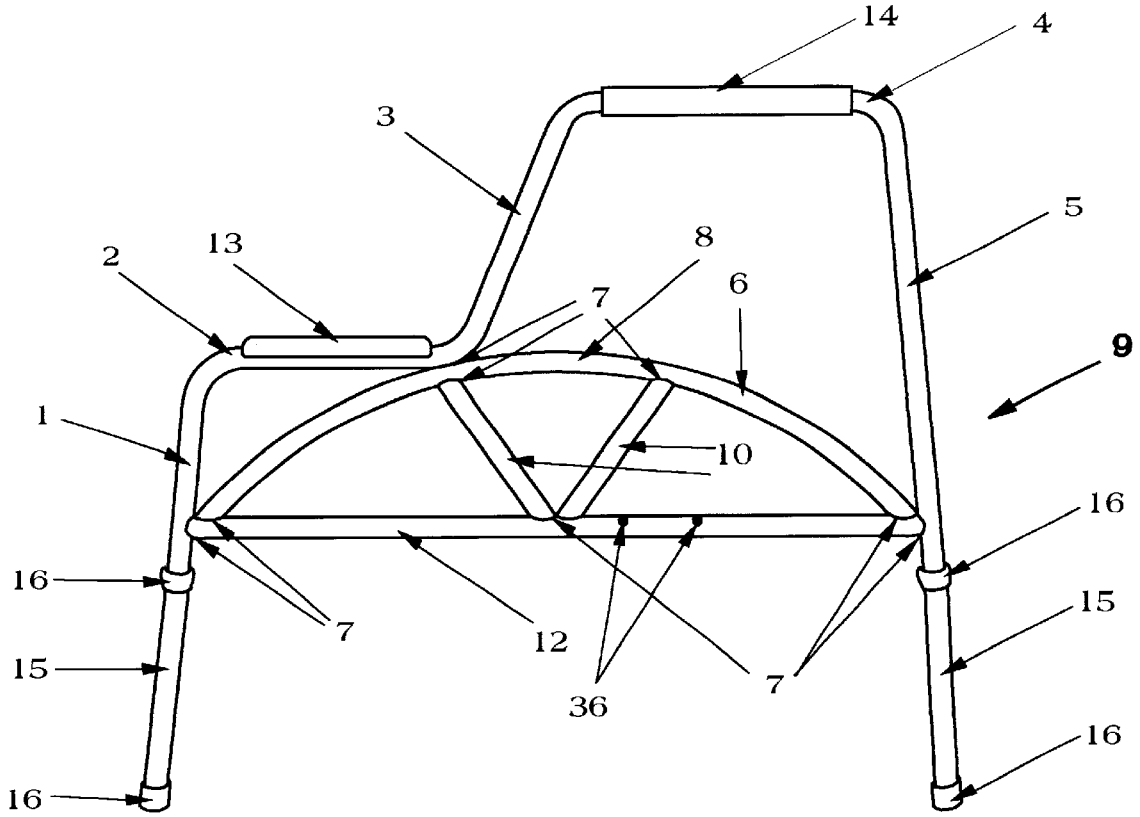
Figure 3:
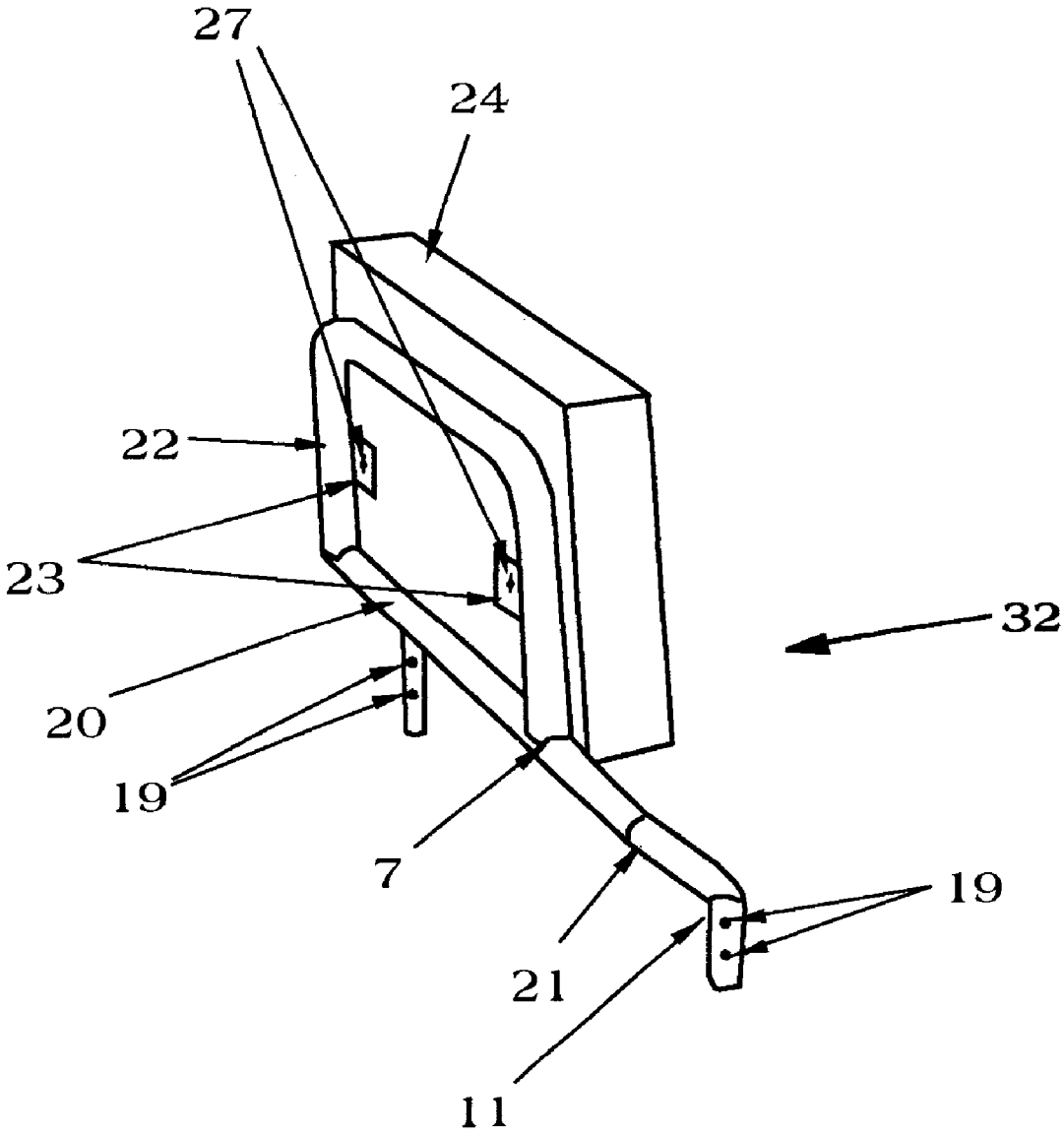
Figure 4:
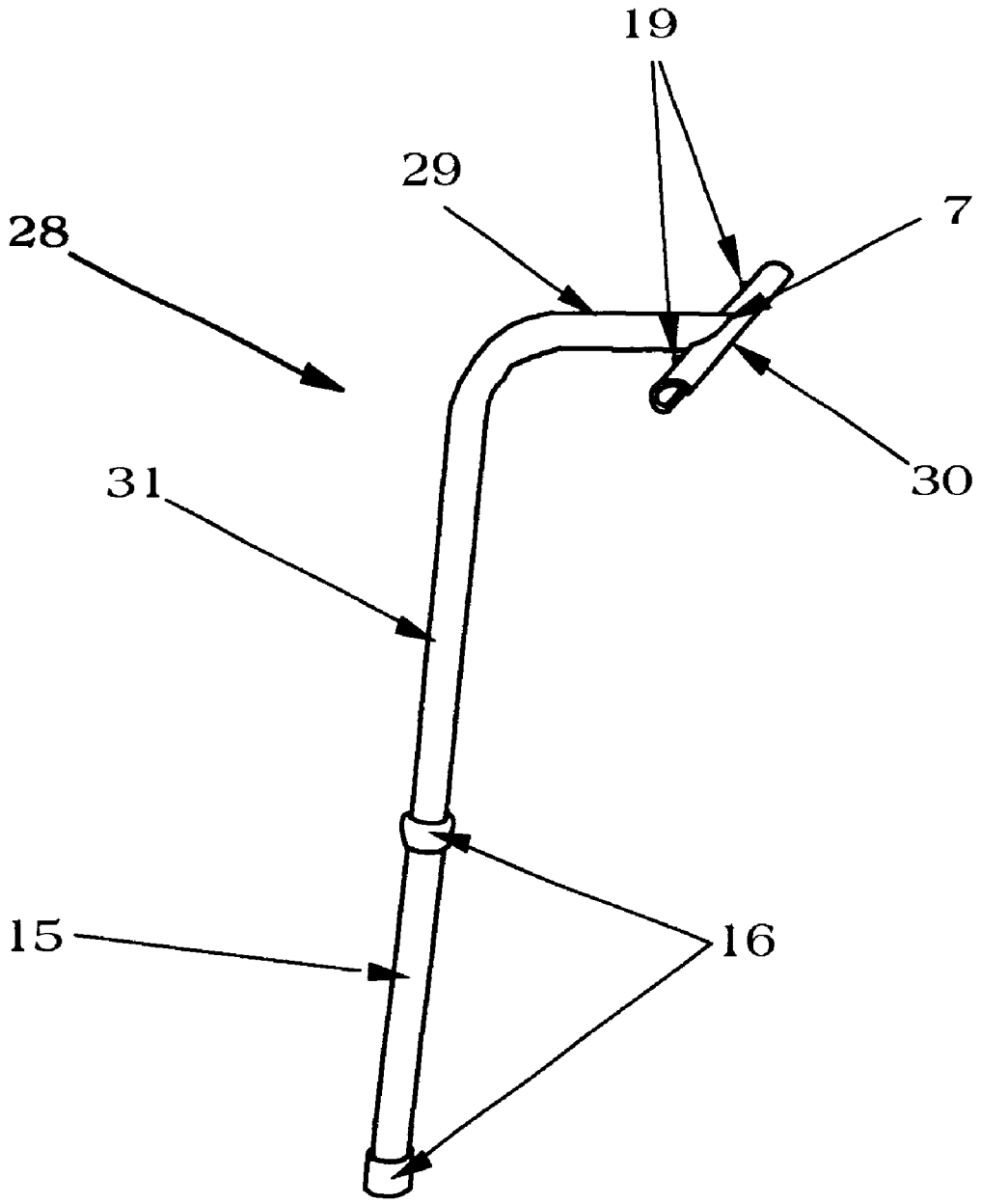

In accordance with the invention, we describe the portable bedside toilet commode of FIG. 1 of which includes the uniquely designed and developed arched support assembly of FIG. 2, the back support of FIG. 3, the tip-inhibiting leg and anti-tip strap of FIG. 4.

The frame design of the portable beside toilet commode of FIG. 1 was uniquely developed. Round tubular steel was used for the prototype. The uniquely designed and developed arched support assembly 9 of FIG. 1 and of FIG. 2 for the identical right and left side units are each formed of five pieces: A long tube that rises at a slight outward incline angle from the floor to the chair arm height (forming the rear leg 1 of the portable bedside toilet commode); then turning horizontal forming the chair arm 2, then slanted member 3 continues at a comfortable angle upward and toward the front until it bends again horizontal to form the standing position hand rail 4, then the member turns again downward at a slight outward incline to form the front leg 5 of the portable bedside toilet commode. The front leg 5 and rear leg 1 are connected further by an arched member 6 that extends from the rear leg 1 up to the front most horizontal point on the lower side of the chair arm 2, attaches there via continuous weld 7 and then proceeds slightly higher to reach an apex 8 halfway between the front leg 5 and rear leg 1. The arched member 6 then proceeds downward until it meets the front leg 5, at a point opposite the rear leg 1. There is a horizontal bar 12 welded 7 at both ends to the arched member 6 and to front leg 5 and rear leg 1. Additional support is given by a set of structural members attaching at the center of the horizontal member 12 of the arched support assembly 9 and extending in a V-pattern 10 up to the intersection of the arched member 6 symmetrical with the vertical centerline, with the rear member of the V-pattern 10 being directly underneath the chair arm 2 at the arched member 6 and chair arm 2 intersection. All members of this unique and structurally strong arched side support assembly 9 (consisting of the multiple-bent and multiple-level front leg 5 and rear leg 1, the arched member 6, the two members of the V-pattern 10, and the side horizontal member 12) are solidly attached to one another by continuous welds 7.

The arched support assembly 9 of the portable bedside toilet commode of FIG. 1 and of FIG. 2 is further enhanced by an arm rest 13 attached to the chair arm 2, a hand grip 14 attached to the standing position hand rail 4, adjustable leg assemblies 15 with position pins (other methods of securing incremental height adjustments may be used without altering the basic concept and unique provisions of this invention) and end covers 16. Further, the arched support assembly 9 of this portable bedside toilet commode of FIG. 1 has holes for receiving bolts 19 during the assembly of the remaining unit pieces of this invention.

The portion of this invention which is referred to as the "chair" has a front chair seat support member 17 running between the right and left arched support assemblies 9. This front chair seat member 17 has, at each end, a compressed area to conform to the shape of the mating members of construction 11. The compressed area mates with the horizontal members 12 of the arched support assemblies 9 and extends toward the rear in sufficient length to allow two bolts/nuts 19 (per side) sufficiently apart to secure the pieces together and inhibit torque. The rear chair seat support member 18 has at each end a compressed area made to conform to the mating members of construction 11. The compressed areas 11 mate with the vertical members of the rear legs 1 of the arched support assemblies 9 and extend downward in sufficient length to allow two bolts/nuts 19 (per side) sufficiently apart to secure the pieces together and inhibit torque. The front 17 and rear 18 horizontal chair seat support sections would have additional cavities cut into the members so as to receive two waste receptacle support brackets 35 for holding the waste receptacle 26. (Other methods of attaching the waste receptacle support brackets 35 and other designs of waste receptacle support brackets 35 do not alter the basic concept and unique provisions of this invention.)

The back support 32 of the portable bedside toilet commode of FIG. 1 and of FIG. 3 is comprised of four structural parts and three attachments. The back support 32 has a horizontal member 20 with ends turned down and at an acute angle to the vertical plane 21; then the extended ends turn downward in a vertical manner and with a compressed area 11 made to conform to the rear leg 1 member. The compressed areas 11 mate with the back side of the rear legs 1 of the arched support assemblies 9 and extend downward, vertically, in sufficient length as to allow two bolts/nuts 19 (per side) sufficiently apart to secure the pieces together and inhibit torque. This back support 32 serves as a structural member, separating the arched side support assemblies 9 at a distance slightly less than that of the chair seat support members 17+18, allowing for a slight outward canter of the sides, further increasing stability. This back support 32 would also have a back-rest 24 consisting of an inverted U-shaped member 22 set in the vertical plane and attached by weld 7 to the back horizontal member 20 of this back support 32. From the inside edges of the two vertical members of the inverted U-shaped member 22 are attached by weld 7 two rectangular flat plates 23 (both extending toward the center). Holes (one each) are drilled in these flat plates 23. A back-rest 24 is bolted onto these flat plates 23. This back rest 24 (a maisonette type material was used for the prototype but other structurally similar materials would serve as well) has two bolts secured to it and extending toward the rear; it is padded and covered with vinyl canvass (thickness of padding and type of material cover may vary without affecting this invention); the back-rest 24 is attached and secured to the back support 32 with bolt/wing nut 29. This back support 32 serves as a structural member tying the unit together and gives additional structural integrity. It also, with the back-rest 24, gives the person a soft backrest area as well as a soft back-impact area when seated on the portable bedside toilet commode of FIG. 1. The back-rest 24 can vary without changing or altering the basic concept and unique provisions of this invention.

The waste receptacle 26 is supported by two support brackets 35 attached to the front 17 and rear 18 chair seat support members. These waste receptacle support brackets 35 can be straight, curved, or angled as long as they lay in a flat plane, attach to the chair seat support members 17+18, and allow the waste receptacle 26 to hang freely below the toilet seat 25.

The toilet seat 25 is attached to the back chair seat support member 18. Depending on which manufactured seat is used, the attachment may vary. The support for the weight of the person using this portable bedside toilet commode is exerted on the toilet seat 25 and is translated to the two horizontal chair seat support members (front 17 & rear 18) and then ultimately to the arched support assemblies 9. The toilet seat 25 used may vary without changing or altering the basic concept and unique provisions of this invention.

Also, as optional attachments to the basic portable bedside toilet commode of FIG. 1, are two side tip-inhibiting legs 28 of FIG. 4. Each tip-inhibiting leg 28 can be mounted outward from the arched support assembly 9 and attached to the mounting holes 36 of the horizontal member 12 of the arched support assembly 9 and are secured by two bolts/nuts 19. Each side tip-inhibiting leg 28 has a slanted member 31 extending outward from the vertical with an adjustable leg length section 15 (same as on the four main legs) and the top horizontal member 29 of this device turns and runs horizontal toward the horizontal member 12 of the arched support assembly 9 and is welded 7 to a conforming-part-member 30 which mates with the horizontal structural member 12 of the arched support assembly 9. The conforming-part-member 30 extends in both directions along the horizontal member 12 of the arched support assembly 9 in sufficient length as to allow one bolt/nut 19 at each end to secure the pieces together and inhibit torque. The length of these tip-inhibiting legs 28 would be slightly shorter than the four support legs 1 & 5 so that these tip-inhibiting legs 28 (one on each side) would not compromise the square setting of the portable bedside toilet commode of FIG. 1 on various floor coverings. Use of the tip-inhibiting legs 28 or the elimination of them does not change or alter the basic concept and unique provisions of this invention. An anti-tip strap 33 of FIG. 4 for securing to the portable bedside toilet commode of FIG. 1 to a bed-frame can be used in lieu of the tip-inhibiting legs 28. This anti-tip strap 33 manufactured of a strong and flexible material 37 (a woven nylon strap was used for this prototype) which can be laced around the bed-frame and the horizontal side member 12 of the arched support assembly 9 of the portable bedside toilet commode. When secured by a fastening device such as a buckle this anti-tip strap 33 would hold the portable bedside toilet commode of FIG. 1 in position and secured to the bed-frame. Use of the anti-tip strap 33 or the elimination of them does not change or alter the basic concept and unique provisions of this invention.

Also, for use and comfort, the addition of a shelf can be added to provide a convenient location to place items such as toilet paper, wipes, etc. Use of a shelf or the elimination of it does not change or alter the basic concept and unique provisions of this invention.

The portable bedside toilet commode of FIG. 1 can be dismantled for transportation and shipping purposes. This invention, fully assembled but without the tip-inhibiting legs 28 will go through a 2'–6" residential interior doorway. If the portable bedside toilet commode of FIG. 1 is scaled larger, for larger people, it may need to be partially dismantled to pass through a 2'–6" residential interior door. Institutions with larger doors should not have trouble moving the unit fully assembled from one room to another room.

The design of this portable bedside toilet commode of FIGS. 1,2,3 and tip-inhibiting leg of FIG. 4 were also designed to minimize manufacturing costs in that the arched support assembly 9, tip-inhibiting leg 28, arm rest 13, and hand grip 14 can all be manufactured without regard to right or left hand design. The adjustable leg sections 15 with end covers 16 for use with the portable bedside toilet commode of FIGS. 1,2 and for use on the tip-inhibiting leg 28 of FIG. 4 are all alike.

DRAWINGS

FIG. 1—Portable Bedside Toilet Commode Legend

1. rear leg
2. chair arm
3. slanted member
4. hand rail
5. front leg
6. arched member
7. continuous weld attachment area between members
8. apex of arch
9. arched support assembly and leg intersection
10. V-support
11. turned down/compressed section mating with structural member
12. horizontal member of the arched support assembly
13. arm rest
14. grip
15. adjustable leg sections
16. end covers
17. front support member of chair section
18. rear support member of chair section
19. bolt/nut
20. back assembly horizontal member
21. acute angle turning of back assembly member
22. inverted U-shaped member
23. rectangular flat member
24. covered, padded back board
25. toilet seat
26. waste receptacle FIG. 2—Tip-Inhibiting Leg Attachment Legend

1. side tip-inhibiting leg
2. adjustable leg section
3. horizontal member
4. continuous weld
5. conforming-part-member
6. bolt FIG. 3—Side Support Assembly Legend

1. one piece multiple-bent, multiple-level front and rear leg member with chair, slant, and standing rails.
2. arched member
3. V-support member
4. horizontal member
5. continuous weld areas
6. adjustable leg sections
7. end covers
8. chair arm
9. hand rail
10. slanted member
11. arm rest
12. grip FIG. 4—Back Support Legend

1. back member
2. U-shaped member
3. cushion attachment areas
4. cushion (back board with padding and cushion)
5. two bolts/nuts
6. turned down/compressed section mating with structural member
7. acute angle turning of the back assembly member
8. wing nuts
9. continuous weld

What is claimed is:

1. A portable bedside commode comprising:

two identical frame members attached at one end to a back support so as to define generally a U-shaped space for reception of a user, the frame members and back support providing support for a removable waste container;

each frame member comprising a long multi-bent member that rises at a slight outward incline angle from a floor to a chair arm height forming a rear leg of the portable bedside toilet commode, then turning horizontally so as to form an arm rest, then slanting at a comfortable angle upward and toward the front until it bends and turns against horizontally to form a standing position hand rail, then the member turns downwardly at a slight forward incline to form a front leg; the front and rear legs are connected further by an arch that extends from the rear leg, attaching to the lower side of the chair arm, reaches an apex halfway between the front and rear legs, then proceeds downwardly until it meets the front leg at a point opposite its rear leg point of attachment; a horizontal member is attached at both ends of the arch and to the front and rear legs; additional support is given by a set of members attached at the center of the horizontal member of the arched support assembly and extending in a V-pattern upwardly and intersecting the arch symmetrically with the vertical centerline of the arched member.

2. The device of claim 1 further comprising a cushioned pad on said back support.

3. The device of claim 1 further comprising an anti-tip leg attachable to either frame member.

4. The device of claim 1 wherein the legs of the frame members are length adjustable.

* * * * *